US009744581B2

(12) United States Patent
Bullard

(10) Patent No.: US 9,744,581 B2
(45) Date of Patent: Aug. 29, 2017

(54) HOLE PUNCHING PLIERS AND METHOD OF USING SAME

(71) Applicant: Patricia Bullard, Southlake, TX (US)

(72) Inventor: Patricia Bullard, Southlake, TX (US)

(73) Assignee: Wubbers LLC, Lubbock, TX (US)

( * ) Notice: Subject to any disclaimer, the term of this patent is extended or adjusted under 35 U.S.C. 154(b) by 286 days.

(21) Appl. No.: 14/062,187

(22) Filed: Oct. 24, 2013

(65) Prior Publication Data

US 2015/0114188 A1 Apr. 30, 2015

(51) Int. Cl.

| | |
|---|---|
| ***B21D 28/34*** | (2006.01) |
| ***B21D 53/44*** | (2006.01) |
| ***B21D 28/24*** | (2006.01) |
| ***B25B 7/02*** | (2006.01) |
| ***B26F 1/36*** | (2006.01) |
| ***B26F 1/44*** | (2006.01) |

(52) U.S. Cl.

CPC ..... *B21D 28/34* (2013.01); *B21D 28/243* (2013.01); *B25B 7/02* (2013.01); *B26F 1/36* (2013.01); *B26F 1/44* (2013.01); *B21D 53/44* (2013.01); *B26F 2001/365* (2013.01); *B26F 2001/4481* (2013.01); *Y10T 83/04* (2015.04)

(58) Field of Classification Search

CPC ..... B21D 28/243; B21D 28/34; B21D 53/44; B25B 7/02; B26F 1/36; B26F 1/44; B26F 2001/365; B26F 2001/4481

See application file for complete search history.

(56) References Cited

U.S. PATENT DOCUMENTS

| | | | | |
|---|---|---|---|---|
| 664,299 | A | 12/1900 | Smith | |
| 3,939,563 | A | 2/1976 | Deike | |
| 5,022,253 | A | 6/1991 | Parlatore | |
| 5,285,703 | A * | 2/1994 | Carson | B25B 7/02 81/176.1 |
| 5,327,652 | A * | 7/1994 | Balback | B26F 1/36 30/229 |
| 5,884,540 | A * | 3/1999 | Mo | B25B 7/04 81/423 |
| 6,115,922 | A | 9/2000 | Kline | |
| 6,282,796 | B1 | 9/2001 | Lin | |

(Continued)

FOREIGN PATENT DOCUMENTS

EP 1526321 A1 4/2005

*Primary Examiner* — Stephen Choi

(74) *Attorney, Agent, or Firm* — Vincent J. Allen; Stephen Y. Liu; Carstens & Cahoon, LLP

(57) ABSTRACT

Disclosed are pliers and related methods for punching a hole in a non-flat material without distorting the material. Such pliers may comprise a first member having a first handle and a first jaw, and a second member having a second handle and a second jaw. The first and second members are attached at a connection point to permit pivoting in response to a squeezing force on the handles. The first jaw comprises a punch tip to be received by the second jaw, where the punch tip may have an angled distal end truncating a cross-section of the punch tip. The second jaw comprises a shaped edge facing the punch tip and extending along a length of the second jaw, the shaped edge having substantially the same shape as the non-flat material and comprising an opening having substantially the same shape as the cross-section of the punch tip and to receive the tip therein.

9 Claims, 7 Drawing Sheets

(56) References Cited

U.S. PATENT DOCUMENTS

| | | | | |
|---|---|---|---|---|
| 6,442,847 | B1 | 9/2002 | Chen | |
| 6,581,293 | B1 | 6/2003 | Andersen | |
| 7,146,738 | B2 | 12/2006 | Yu | |
| 7,191,525 | B2 * | 3/2007 | Brailovskiy | B25B 7/126 30/180 |
| 7,895,756 | B1 | 3/2011 | Lin | |
| 2006/0156474 | A1 * | 7/2006 | Gillingham | A62B 3/005 7/129 |
| 2008/0118884 | A1 * | 5/2008 | Leslie-Martin | A61C 13/12 433/4 |
| 2010/0095726 | A1 * | 4/2010 | Buettner | B21D 22/04 72/203 |

* cited by examiner

HOLE PUNCHING PLIERS AND METHOD OF USING SAME

BACKGROUND

1. Technical Field

The present disclosure relates to a tool for manufacturing jewelry and a method of using such tool. More particularly, the present disclosure relates to a jewelry tool constructed in the form of hole punching pliers and related methods, which can be used to hole punch in a material without distorting the material.

2. Description of Related Art

Jewelers have long relied on a variety of tools to fabricate jewelry or the materials used in jewelry designs. Among the tools a jeweller or other craftsperson often employs is a tool for making or punching holes. While a number of tools exist for punching holes in soft materials, such as thin metals and the like, a common problem also consistently arises. Specifically, when holes are punched through such thin metals and other similar materials that are not flat, the material is typically distorted in the area of the punched hole.

For example, if a hole is desired in a corner or a curved surface of thin, soft metal, as the punch tip of the tool engages the material, the material is pressed against a receiving anvil. Then, as the punch tip begins pressing against and through the material, the material tends to buckle and distort close to the edges of the hole as the hole is formed. Conventional receiving anvils in punching tools are simply flat surfaces having a cut out or hole similarly shaped and sized to receive the punch tip forming the hole in the material. Even in hole punch tools that are handheld, such as a pair of pliers, one jaw typically has the punch tip, while the opposing jaw comprises a flat receiving anvil. However, as mentioned above, such conventional designs, even in handheld tools, still deform softer materials like thin metals as the hole is being punched through material that is not flat.

In view of the foregoing deficiencies of conventional approaches, the disclosed principles provide for a hole punch tool, such as a pair of pliers, as well as related methods of manufacturing and using such a hole punch tool, that do not suffer from the deficiencies of the prior art.

SUMMARY

The present disclosure provides tools and related methods of manufacturing and use for punching a hole in a non-flat material without distorting the material. In one embodiment, a pair of pliers constructed as disclosed herein may comprise a first member having a first handle on a proximal end of the first member and a first jaw on a distal end of the first member, as well as a second member having a second handle on a proximal end of the second member and a second jaw on a distal end of the second member. With such an exemplary pair of pliers, the first member and the second member are attached via at least one connection point to permit pivoting movement between the first jaw and the second jaw such that the first jaw and the second jaw are opposed and adapted for moving with respect to each other in response to a force being applied to the first handle and the second handle. In addition, in exemplary embodiments, the first jaw may comprise a punch tip extending therefrom and configured to be received by the second jaw, where the punch tip has a non-flat distal end truncating a cross-section of the punch tip. Moreover, in such embodiments, the second jaw comprises a shaped edge facing the punch tip and extending along a length of the second jaw, and the shaped edge comprises an opening having substantially the same shape as the cross-section of the punch tip and configured to receive the punch tip therein upon the application of a squeezing force to the first and second handles.

In other embodiments, a pair of pliers for forming a hole in a non-flat material constructed in accordance with the disclosed principles may comprise a first member having a first handle on a proximal end of the first member and a first jaw on a distal end of the first member, as well as a second member having a second handle on a proximal end of the second member and a second jaw on a distal end of the second member. In exemplary embodiments, the first member and the second member are attached via at least one connection point to permit pivoting movement along an arc between the first jaw and the second jaw such that the first jaw and the second jaw are opposed and adapted for moving with respect to each other in response to a force being applied to the first handle and the second handle. In addition, the first jaw may comprise a punch tip extending therefrom and configured to be received by the second jaw, where the punch tip has an angled distal end truncating a cross-section of the punch tip. Furthermore, in such embodiments, the second jaw comprises a shaped edge facing the punch tip and extending along a length of the second jaw, where the shaped edge comprises an opening having substantially the same size and shape as the cross-section of the punch tip and configured to receive the punch tip therein upon the application of a squeezing force to the first and second handles.

In another aspect, methods of punching a non-flat material using a pair of pliers in accordance with the disclosed principles are also disclosed. In an exemplary embodiment, such a method may comprise placing the material between a first jaw and a second jaw of a pair of pliers, where the first and second jaws are located on distal ends of corresponding first and second members. In addition, the first and second member have respective first and second handles on proximal end thereof. Furthermore, in such exemplary embodiments, a method may further include punching a hole in the material by applying a squeezing force to the first and second handles, wherein the first member and the second member are attached via at least one connection point to permit pivoting movement between the first jaw and the second jaw such that the first jaw and the second jaw are opposed and adapted for moving with respect to each other in response to a force being applied to the first handle and the second handle. Additionally, in such embodiments, the first jaw may comprise a punch tip extending therefrom and configured to be received by the second jaw for punching the hole, wherein the punch tip has an angled distal end truncating a cross-section of the punch tip. Also, in such embodiments, the second jaw may comprise a shaped edge facing the punch tip and extending along a length of the second jaw, where the shaped edge comprises an opening having substantially the same shape as the cross-section of the punch tip and configured to receive the punch tip when punching the hole.

DETAILED DESCRIPTION

Figure 1A:
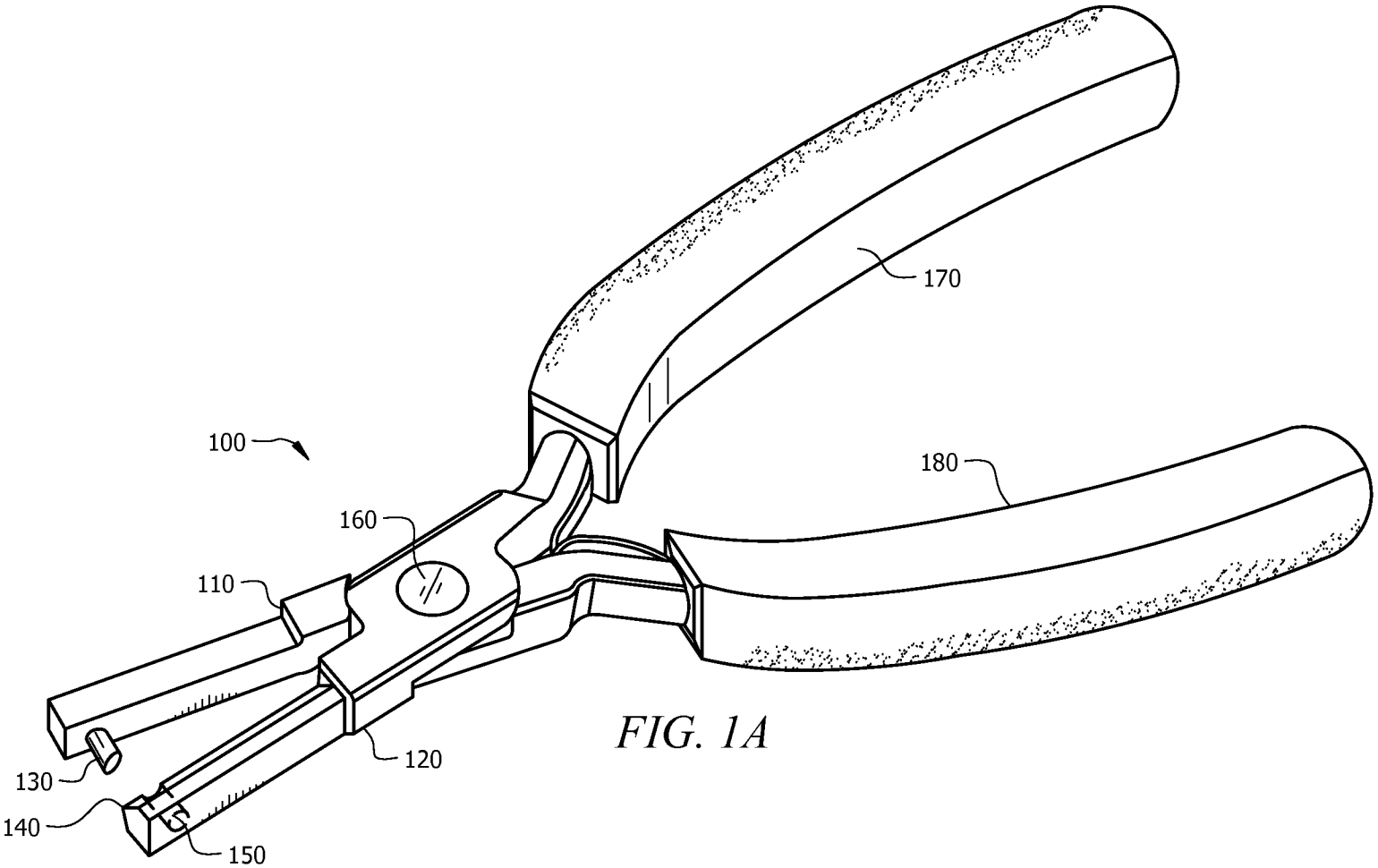
FIG. 1A is a perspective view of one embodiment of a pair of hole punch pliers in accordance with the disclosed principles.

Referring now to FIG. 1A, illustrated is a perspective view of a pair of hole punching pliers in accordance with an embodiment of disclosed principles. The pliers 100 have first and second jaws 110, 120, each having a cross sectional area along a length from the tip of each jaw to the raised areas that are near a pivot 160 of the pliers 100. On the opposing ends of the jaws 110, 120, opposite the pivot 160, are first and second handles 170, 180. Thus, the application of a squeezing pressure on the first and second handles 170, 180 results in a closing of the first and second jaws 110, 120 via the pivot 160. In other embodiments, the pliers 100 may comprise multiple pivot points between the handles 170, 180 and the jaws 110, 120 such that the jaws 110, 120 close towards one another while maintaining a parallel relationship with regard to the distal and proximal ends of the jaws 110, 120.

Also illustrated in FIG. 1A, the first jaw 110 includes a punch tip 130 extending therefrom and towards the second jaw 120. Similarly, the second jaw 120 includes a receiving anvil comprising a shaped edge, which in this embodiment is an angled edge 140, extending towards the punch tip 130 of the first jaw 110. Additionally, the angled edge 140 and second jaw 120 include a receiving opening configured to receive the punch tip 130 when the first and second jaws 110, 120 are moved towards each other when closing. As shown, the angled edge 140 may extend along substantially the entire length of the second jaw 120, but in other embodiments, the angled edge 140 may only extend along a portion of the second jaw 120.

With regard to the receiving opening 150, in exemplary embodiments the opening 150 may be sized sufficiently to receive the punch tip 130 therein. In more specific embodiments, the opening 150 may also be sized slightly larger than the punch tip 130 such that a precise fit of the punch tip 130 within the opening 150 is achieved. Furthermore, in some embodiments, the opening 150 may pass entirely through the second jaw 120; however, alternatively, the opening 150 may instead comprise a recess into the angled edge 140 without passing through the entire second jaw 120.

Figure 1B:
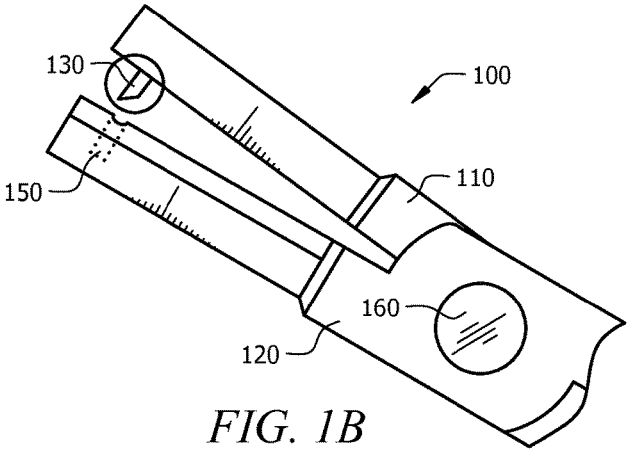
FIG. 1B is a side view of the jaws of a pair of hole punch pliers in accordance with an embodiment of the disclosed principles.

Turning now to FIG. 1B, illustrated is a side view of the first and second jaws 110, 120 of the pair of hole punch pliers 100 illustrated in FIG. 1A. As before, the punch tip 130 is illustrated as connected to and extending from the first jaw 110, while the angled edge 140 having the receiving opening 150 is shown on the second jaw 120. In addition, the size and shape of the opening 150 is sized and shaped to receive the punch tip 130 when the first and second jaws 110, 120 are closed via the pivot 160.

Figure 1C:
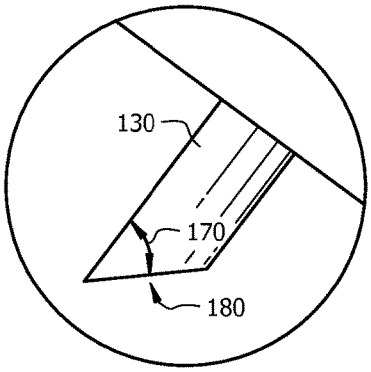
FIG. 1C is a close up of a side view of the punch tip of the hole punch pliers illustrated in FIG. 1B.

FIG. 1C illustrates a close up of the distal end of the punch tip 130 of the pliers 100 illustrated in FIGS. 1A and 1B. More specifically, in this embodiment, the distal end of the punch tip 130 comprises an acute angle 170, which results in a chiselled distal end of the punch tip 130. Such a chiselled shape can allow the punch tip 130 to more easily punch through given materials when using the disclosed pliers 100. In exemplary embodiments, the angle 170 of the chiselled tip is approximately 45 degrees; however, in other embodiments other angles may also be employed. Additionally, in this embodiment, the distal end of the punch tip 130 is a flat surface 180 comprising the chiselled end.

Turning briefly back to FIG. 1B, the rotational position of the chiselled end of a punch tip in accordance with the disclosed principles may be altered, as desired. Specifically, while the leading edge of the chiselled end of the punch tip 130 in FIG. 1B is shown closest to the distal ends of the jaws 110, 120 of the pliers 100, the connection of the punch tip 130 to the first jaw 110 may be made adjustable. As such, the punch tip 130 could be rotated so that the leading tip of the chiselled end can be selectively position. For example, for some materials, the punching of a hole in that material may be better accomplished by having the leading tip of the chiselled end closest to the pivot 160 of the pliers 100, as opposed to the distal ends of the jaws 110, 120. Of course, any other rotational position for the punch tip 130 may also be accomplished in such embodiments.

Figure 1D:
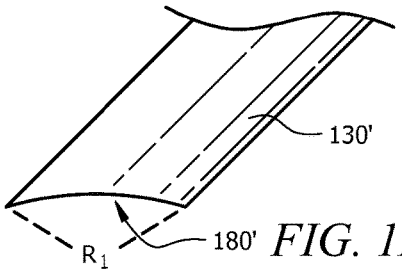
FIG. 1D is a close up of a side view of an alternative punch tip for a pair of hole punch pliers constructed in accordance with the disclosed principles.

Looking now at FIG. 1D, illustrated is a close up of an alternative embodiment of a punch tip 130' constructed in accordance with the disclosed principles. In the embodiment illustrated in FIG. 1D, the distal end of the punch tip 130 comprises a curved surface 180' having a radius of curvature $R_1$. Including such a curved distal end of the punch tip 130' may further assist the punch tip 130' in punching through a given material when employing the pliers. Of course, any advantageous radius of curvature may be employed with a punch tip in accordance with the disclosed principles depending on the radius or shape of the material to be punched, and the present disclosure is not limited to any specific radius or shape.

Figure 2A:
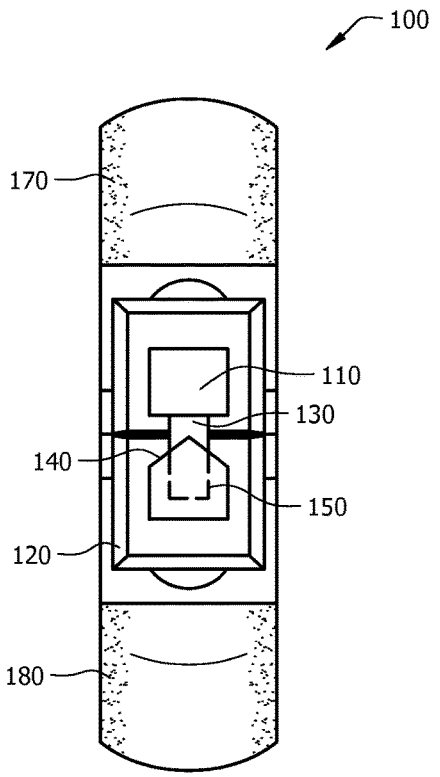
FIG. 2A is an end view of a pair of hole punch pliers in accordance with an embodiment of the disclosed principles with the jaws closed.
Figure 2B:
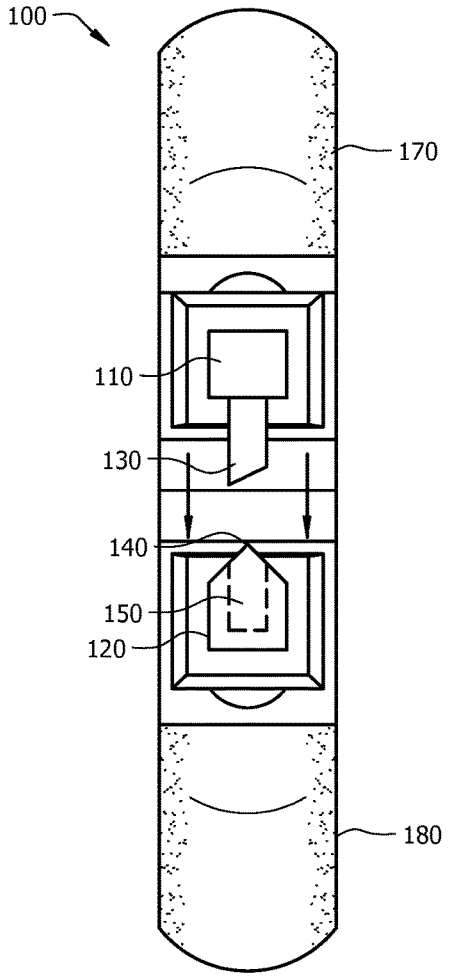
FIG. 2B is an end view of a pair of hole punch pliers in accordance with an embodiment of the disclosed principles with the jaws open.

Referring now at FIG. 2A, illustrated is an end view of the pair of hole punch pliers 100 illustrated in FIG. 1A with the jaws closed. As discussed above, the first and second jaws 110, 120 are again illustrated, as are the punch tip 130 connected to and extending from the first jaw 110, and the angled edge 140 extending from the second jaw 120 towards the first jaw 110. Additionally, the opening 150 is also again illustrated, and in this view is shown as receiving the punch tip 130 therein when the jaws 110, 120 of the pliers 100 are in a closed position. FIG. 2B is an end view of the hole punch pliers shown in FIG. 2A, but with the jaws 110, 120 in an open position. Again the punch tip 130, angled edge 140, and receiving opening 150 are illustrated in this end view of the pliers 100.

Figure 3A:
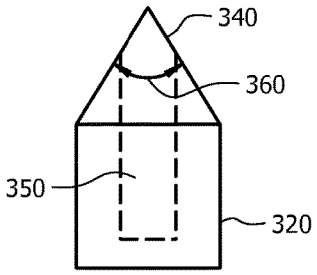
FIG. 3A is an end view of an alternative embodiment of a jaw having a narrow angled receiving edge in accordance with the disclosed principles.
Figure 3B:
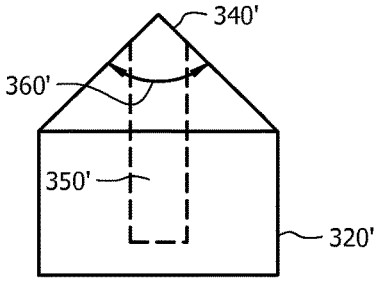
FIG. 3B is an end view of an alternative embodiment of a jaw having a wide angled receiving edge in accordance with the disclosed principles.

In the illustrated embodiments of FIGS. 2A and 2B, the angle edge 140 of the second jaw 120 comprises an angle of about 90 degrees, with an approximate 45 degree slope in each opposing direction from the tip of the shaped or angled edge 140 to the outer sides of the second jaw 120. However, other angles and shapes may also be employed, as desired, for the shaped edge 140. For example, FIG. 3A illustrates an end view of an alternative embodiment of a second jaw 320 having an angled edge 340 as disclosed herein. In this embodiment, the angle 360 of the angled edge 340 is less than 90 degrees, for example, approximately 45 degrees. Despite the acute angle 360 for the angled edge 340, a receiving opening 350 is also still included for receiving a punch tip as disclosed herein. Moreover, as illustrated in FIG. 3B, an angle 360' larger than 90 degrees may also be employed for the angled edge 340' of a pair of pliers constructed as disclosed herein. In this embodiment, an angle of approximately 120 degrees is employed, however, almost any angle larger than 90 degree could also be employed, if desired. As before, a receiving opening 350' is also still included in the angled edge 340' for receiving a punch tip as disclosed herein.

Figure 4A:
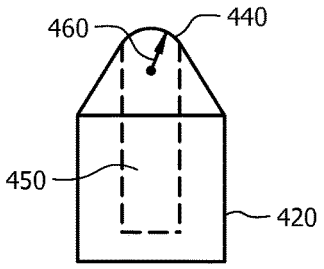
FIG. 4A is an end view of another alternative embodiment of a jaw having a narrow rounded receiving edge in accordance with the disclosed principles.
Figure 4B:
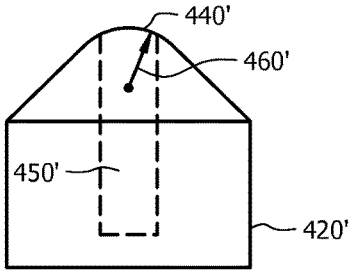
FIG. 4B is an end view of another alternative embodiment of a jaw having a wide rounded receiving edge in accordance with the disclosed principles.

Looking at FIGS. 4A and 4B, other shapes may be provided for the shaped edge 440, 440', as discussed above. More specifically, FIG. 4A illustrates a bottom jaw 420 of a pair of hole pliers having a partially triangular shape with a rounded shaped edge 440 for receiving a material have a curved shape. The radius of curvature 460 for the rounded edge 440 maybe relatively small, as each application may require. Similarly, FIG. 4B illustrates a bottom jaw 420' also having a partially triangular shape with a rounded edge 440'. However, in this embodiment, the rounded edge 440' has a much larger radius of curvature 460' as compared to the shaped edge 440 illustrated in FIG. 4A. In both embodiments, openings 450, 450' are also provided for receiving a punch tip therein when punching a hole in the non-flat, curved material (not illustrated) placed on either of the rounded shaped edges 440, 440'. Moreover, the disclosed principles are not limited to shaped edges having on the illustrated angled or rounded edges, and instead are broad enough to encompass any desired shape for the shaped edge that substantially corresponds to shape of the non-flat material being punched.

Figure 5A:
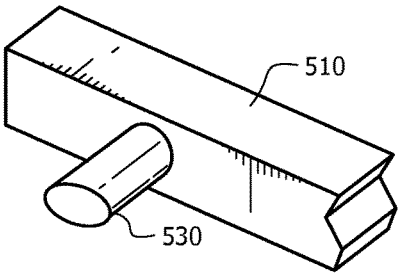
FIG. 5A is a perspective view of an alternative embodiment of an oval-shaped punch tip in accordance with the disclosed principles.
Figure 5B:
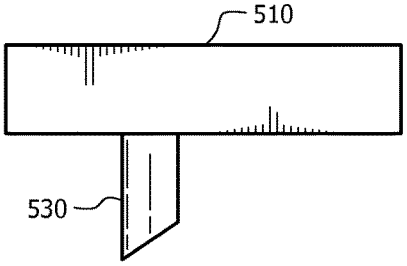
FIG. 5B is a side view of the embodiment of a jaw illustrated in FIG. 5A.

Turning now to FIGS. 5A and 5B, illustrated are perspective and side views of an alternative embodiment for a punch tip for a pair of hole punch pliers in accordance with the disclosed principles. Specifically, a first jaw 510 of a pair of hole punch pliers is illustrated having an oval-shaped punch tip 530 extending therefrom. A cross-section of this punch tip 530 provides an oval shape for the punch tip 530, which would be used to form oval-shaped holes in a given material. In accordance with the disclosed principles, a receiving opening (not illustrated) having a corresponding oval shape may be provided in a second jaw for receiving the oval-shaped punch tip 530. Moreover, that receiving opening may also be similarly sized as the oval-shaped punch tip 530. Furthermore, the oval-shaped punch tip 530 may also include an angled distal end, which forms a chiselled tip as illustrated. Such chiselled tip may be comprised of a flat angled surface or an angled surface having a radius of curvature as discussed above with respect to FIG. 1D. Moreover, the rotational position of the punch tip 530 may also be adjusted with respect to the jaw 510, as discussed above.

Figure 6A:
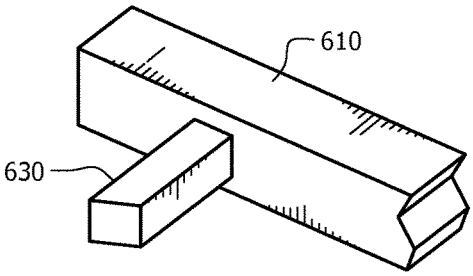
FIG. 6A is a perspective view of another alternative embodiment of a square-shaped punch tip in accordance with the disclosed principles.
Figure 6B:
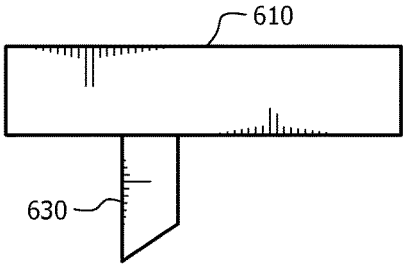
FIG. 6B is a side view of the embodiment of a jaw illustrated in FIG. 6A.

FIGS. 6A and 6B illustrate a perspective view and a side view of another alternative embodiment for a punch tip for a pair of hole punch pliers constructed in accordance with the disclosed principles. In this embodiment, a first jaw 610 of a pair of hole punch pliers is illustrated having a square-shaped punch tip 630 extending therefrom. A cross-section of this punch tip 630 provides a square shape for the punch tip 630, which would be used to form square-shaped holes in a given material. As before, a receiving opening (not illustrated) having a corresponding square shape may be provided in a second jaw for receiving the square-shaped punch tip 630. Also as before, such a square receiving opening may also be similarly sized as the square-shaped punch tip 630. Furthermore, the square-shaped punch tip 630 may also include an angled distal end, which forms the illustrated chiselled tip. Once again, such chiselled tip may be comprised of a flat angled surface or an angled surface having a radius of curvature as discussed above with respect to FIG. 1D. Moreover, the rotational position of the punch tip 630 may also be adjusted with respect to the jaw 610, as discussed above.

Figure 7A:
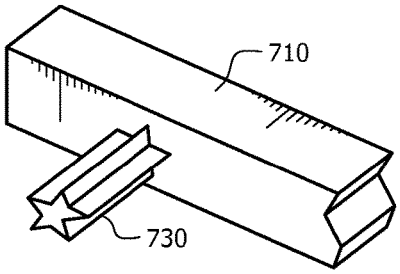
FIG. 7A is a perspective view of yet another alternative embodiment of a star-shaped punch tip in accordance with the disclosed principles.
Figure 7B:
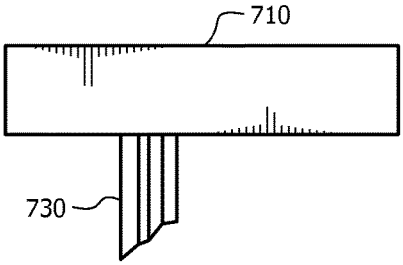
FIG. 7B is a side view of the embodiment of a jaw illustrated in FIG. 7A.

FIGS. 7A and 7B illustrate a perspective view and a side view of yet another alternative embodiment for a punch tip for a pair of hole punch pliers constructed in accordance with the disclosed principles. In this embodiment, a first jaw 710 of a pair of hole punch pliers is illustrated having a star-shaped punch tip 730 extending therefrom. A cross-section of this punch tip 730 provides a star shape for the punch tip 730, which would be used to form star-shaped holes in a given material. As before, a receiving opening (not illustrated) having a corresponding star shape may be provided in a second jaw for receiving the star-shaped punch tip 730. Also as before, such a star-shaped receiving opening may also be similarly sized as the star-shaped punch tip 730. Furthermore, the star-shaped punch tip 730 may also include an angled distal end, which forms the illustrated chiselled tip. Once again, such chiselled tip may be comprised of a flat angled surface or an angled surface having a radius of curvature as discussed above with respect to FIG. 1D. Moreover, the rotational position of the punch tip 730 may also be adjusted with respect to the jaw 710, as discussed above.

Figure 8A:
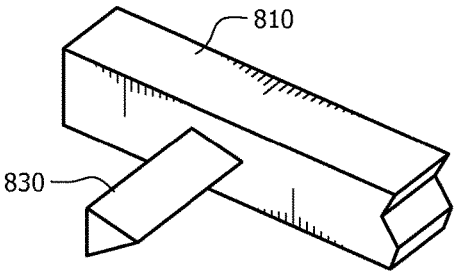
FIG. 8A is a perspective view of yet another alternative embodiment of a triangle-shaped punch tip in accordance with the disclosed principles.
Figure 8B:
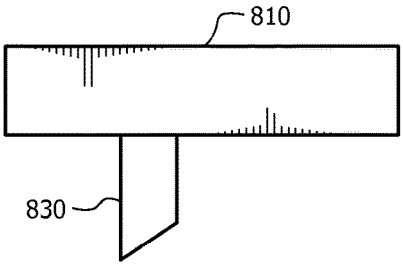
FIG. 8B is a side view of the embodiment of a jaw illustrated in FIG. 8A.

FIGS. 8A and 8B illustrate a perspective view and a side of yet another alternative embodiment for a punch tip for a pair of hole punch pliers constructed in accordance with the disclosed principles. In this embodiment, a first jaw 810 of a pair of hole punch pliers is illustrated having a triangle-shaped punch tip 830 extending therefrom. A cross-section of this punch tip 830 provides a triangle shape for the punch tip 830, which would be used to form triangle-shaped holes in a given material. As before, a receiving opening (not illustrated) having a corresponding triangle shape may be provided in a second jaw for receiving the triangle-shaped punch tip 830. Also as before, such a triangle-shaped receiving opening may also be similarly sized as the triangle-shaped punch tip 830. Furthermore, the triangle-shaped punch tip 830 may also include an angled distal end, which forms the illustrated chiselled tip. Once again, such chiselled tip may be comprised of a flat angled surface or an angled surface having a radius of curvature as discussed above with respect to FIG. 1D. Moreover, the rotational position of the punch tip 830 may also be adjusted with respect to the jaw 810, as discussed above.

Although the punch tips discussed herein are illustrated in a number of different shapes, such as circular, oval, square, triangle, and star, various other shapes may also be utilized for the punch tip without departing from the spirit and scope of the disclosed principles. Moreover, although a single leading edge of the chiselled end of such punch tips are discussed herein, the disclosed principles may also be extended to include punch tips with two or more leading edges, if desired, or that are flat with all edges contacting the material simultaneously.

Figure 9:
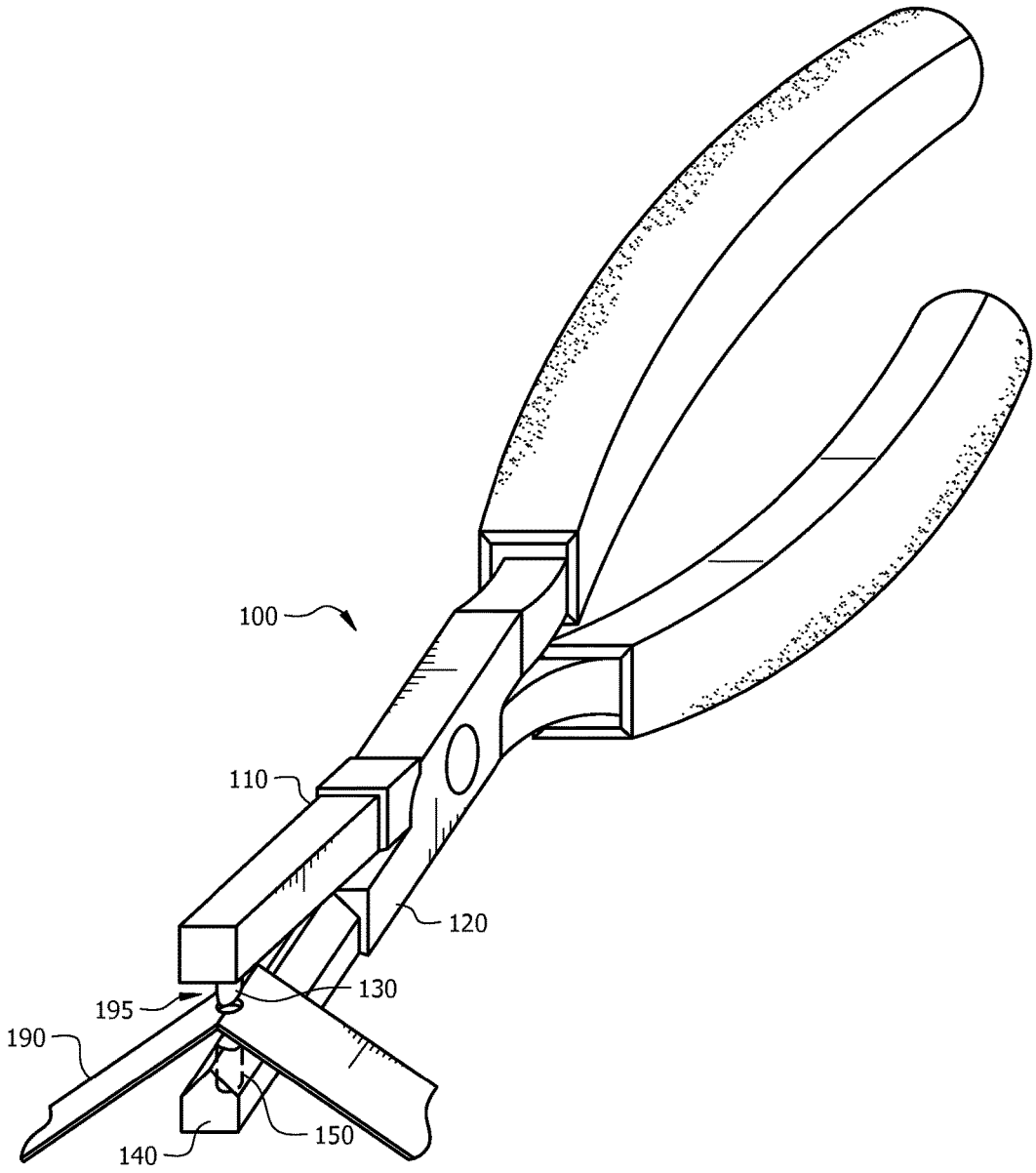
FIG. 9 illustrates a perspective view of the exemplary pair of hole punch pliers illustrated in FIG. 1 as employed to punch a hole in an angled material.

Looking now at FIG. 9, illustrated is a perspective view of the exemplary pair of hole punch pliers 100 illustrated in FIG. 1 as employed to punch a hole in a non-flat material. More specifically, in operation, pliers 100 constructed in accordance with the disclosed principles employ the angled edge 140 of one of the jaws 120 as the anvil for an angled material 190 having a hole 195 punched therethrough with a punch tip 130. As the upper jaw 110 is closed towards the bottom jaw 120, the punch tip 130 contacts the material 190 via the distal end of the chiselled tip. As the tip contacts the material 190, the angled material 190, specifically the material's angled corner, is pressed against the angled edge 140 of the bottom jaw 120. Accordingly, the material 190 is initially contacted, simultaneously, by the chiselled tip and the angled edge at the same location, but on opposing surfaces of, the material 190. The physical result of this the two angled edges (i.e., the angled edge 140 and the chiselled end of the punch tip 130) is that the angled corner of the material 190 resists distortion as the punch tip 130 begins to pierce the material's 190 upper surface.

Figure 10:
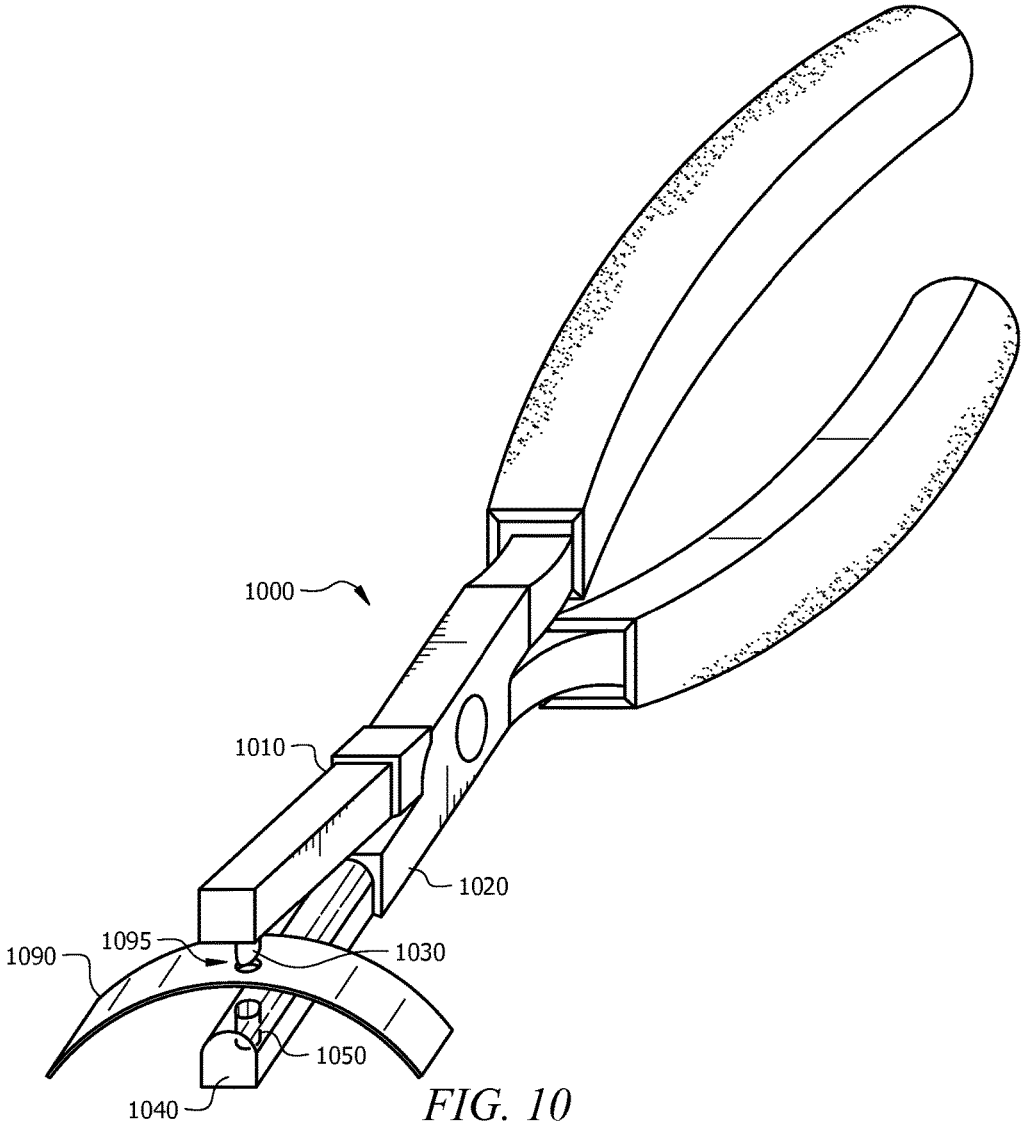
FIG. 10 illustrates a perspective view of another exemplary pair of hole punch pliers as employed to punch a hole in a curved material.

FIG. 10 illustrates a perspective view of another embodiment of a pair of hole punch pliers 1000 constructed in accordance with the disclosed principles. As before, these pliers 1000 also include first and second handles attached to first and second jaws 1010, 1020. Also as before, the upper jaw 1010 comprises a punch tip 1030, which may include a specific shape as disclosed herein for punching a hole in a material. In addition, the bottom jaw 1020 comprises a receiving edge 1040, which in this embodiment is a circular rounded edge 1040 having a predetermined radius of curvature. In accordance with the disclosed principles, the radius of curvature of the receiving edge 1040 is substantially equal to the radius of curvature of the material 1090 being grasped by the jaws 1010, 1020 for punching a hole 1095 therethrough. The receiving edge 1040 also includes a receiving opening 1050 for receiving the punch tip 1030, as discussed in detail above.

In this embodiment, as the curved material 1090 is grasped by the jaws 1010, 1020, the rounded receiving edge 1040 provides an improved anvil or receiving surface for the curved material 1090 as compared to the flat anvil surfaces employed in conventional punch hole pliers. Those conventional flat anvil surfaces result in undesirable bending or otherwise distorting the non-flat material 1090 as the pliers grasp the material 1090 and punch a hole therethrough. By providing a curved receiving edge 1040 that not only is curved in the same direction as the material 1090, but also has a curvature that substantially matches the curvature of the material 1090 being punched, pliers 1000 in accordance with the disclosed principles may be used to punch the desired hole 1095 through the material 1090, but without distorting the material 1040 or its curvature as the punch tip 1030 punches through the material 1090 to form the hole 1095. As mentioned before, although a rounded receiving edge 1040 is illustrated in FIG. 10, other shapes for the shaped receiving edge of the bottom jaw of pliers constructed as disclosed herein are also within the broad scope of the disclosed principles, and may be selected to match any shape and/or curvature of a non-flat material being punched.

In sum, with conventional punch pliers, the bottom jaw comprises a flat surface on which the material being punched rests while the punch tip pierces the material. However, employing such an even surface results in the material distorting as the punch tip presses down on and pierces the non-flat material. In contrast, the shaped edge of hole punch pliers constructed as disclosed herein limits the receiving surface under the material to a shaped edge that compliments the leading, chiselled end of the punch tip. This limiting of the receiving surface to only a shaped edge that compliments the shape of the non-flat material being punched substantially reduces or eliminates distortion in the material as a hole is being punched therethrough. As a result, hole punch pliers constructed according to the disclosed principles allow users, such as jewellers or other craftspersons, to successfully punch even very malleable materials without distorting such materials as often occurs with conventionally designed pliers.

Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention. For example, the shapes of the jaws could be any shape desired by the jeweler, including non-traditional shapes.

What is claimed is:

1. A pair of pliers for forming a hole in a non-flat material, said pliers comprising:

a first member having a first handle on a proximal end of said first member and a first jaw on a distal end of said first member;

a second member having a second handle on a proximal end of said second member and a second jaw on a distal end of said second member;

wherein said first member and said second member are attached at least one connection point to permit pivoting movement between said first jaw and said second jaw such that said first jaw and said second jaw are opposed and adapted for moving with respect to each other in response to a force being applied to said first handle and said second handle;

wherein said first jaw comprises a punch tip extending therefrom and configured to be received by an opening defining one end of a passage extending at least partially through said second jaw; and wherein said second jaw comprises a shaped edge being a straight line apex formed from two non-parallel, planar surfaces converging towards each other in a direction towards said first jaw; and wherein said shaped edge comprises said opening having substantially the same shape as a cross-section of said punch tip, and wherein said passage is configured to receive said punch tip therein upon the application of a squeezing force to said first and second handles.

2. The pair of pliers in accordance with claim 1, wherein said punch tip comprises a substantially cylindrical shape with a circular cross-section.

3. The pair of pliers in accordance with claim 1, wherein said punch tip comprises a substantially rectilinear cross-section.

4. The pair of pliers in accordance with claim 1, wherein the punch tip further comprises a distal end having an area defined by a plane that is angled relative to the second jaw.

5. The pair of pliers in accordance with claim 4, wherein said punch tip is rotatable such that a position of a leading edge of said punch tip is adjustable with respect to said first jaw.

6. The pair of pliers in accordance with claim 4, wherein the plane is curved.

7. The pair of pliers in accordance with claim 1, wherein said opening is sized substantially the same as a size of said cross-section of said punch tip received therein.

8. The pair of pliers in accordance with claim 1, wherein at least one of said first jaw or second jaw is removable with respect to their corresponding first member or second member.

9. The pair of pliers in accordance with claim 1, wherein said connection point permits pivoting movement along an arc between said first jaw and said second jaw.

* * * * *